US006063742A

United States Patent [19]

Konzman

[11] Patent Number: 6,063,742

[45] Date of Patent: May 16, 2000

[54] GREASE COMPOSITIONS

[75] Inventor: Edward J. Konzman, Eastlake, Ohio

[73] Assignee: The Lubrizol Corporation, Wickliffe, Ohio

[21] Appl. No.: 09/258,949

[22] Filed: Mar. 1, 1999

[51] Int. Cl.[7] ..... C10M 141/10

[52] U.S. Cl. ..... 508/368; 508/398; 508/399; 508/423; 508/429; 508/434; 508/435; 508/437; 508/440; 508/442

[58] Field of Search ..... 508/398, 399, 508/423, 429, 434, 435, 437, 440, 442, 368

[56] References Cited

U.S. PATENT DOCUMENTS

| | | | |
|---|---|---|---|
| 2,872,417 | 2/1959 | Jordan et al. | 252/42.1 |
| 2,923,682 | 2/1960 | Morway | 252/32.7 |
| 3,033,787 | 5/1962 | Morway et al. | 252/39 |
| 3,174,931 | 3/1965 | Matson et al. | 252/37.2 |
| 3,219,666 | 11/1965 | Norman et al. | 508/233 |
| 3,318,807 | 5/1967 | Lyons et al. | 252/18 |
| 3,389,085 | 6/1968 | Morway | 252/41 |
| 4,234,435 | 11/1980 | Meinhardt et al. | 508/232 |
| 4,410,435 | 10/1983 | Naka et al. | 252/42.1 |
| 4,536,308 | 8/1985 | Pehler et al. | 252/32.7 |
| 4,582,617 | 4/1986 | Doner et al. | 242/32.7 |
| 4,600,517 | 7/1986 | Doner et al. | 252/32.7 |
| 4,655,948 | 4/1987 | Doner et al. | 252/49.6 |
| 4,743,386 | 5/1988 | Doner et al. | 252/49.6 |
| 4,752,416 | 6/1988 | Scharf et al. | 252/78.5 |
| 4,780,227 | 10/1988 | Doner et al. | 252/32.7 |
| 4,781,850 | 11/1988 | Doner et al. | 252/49.6 |
| 4,828,732 | 5/1989 | Doner et al. | 252/32.7 |
| 4,828,734 | 5/1989 | Doner et al. | 252/49 |
| 4,842,752 | 6/1989 | Hardy et al. | 252/17 |
| 4,897,210 | 1/1990 | Newsoroff | 252/41 |
| 4,961,868 | 10/1990 | Doner et al. | 252/32.7 |
| 5,068,045 | 11/1991 | Doner et al. | 252/32.007 |
| 5,084,194 | 1/1992 | Doner et al. | 252/32.7 |
| 5,211,860 | 5/1993 | Doner et al. | 252/32.7 |
| 5,211,863 | 5/1993 | Doner et al. | 252/49.6 |
| 5,256,320 | 10/1993 | Todd et al. | 252/32.007 |
| 5,256,321 | 10/1993 | Todd | 252/32.007 |
| 5,362,409 | 11/1994 | Wiggins et al. | 252/32.7 |
| 5,472,626 | 12/1995 | Musilli | 252/41 |

FOREIGN PATENT DOCUMENTS

| | | | |
|---|---|---|---|
| 0084910 | 8/1983 | European Pat. Off. | C10M 5/14 |
| 0227182 | 12/1986 | European Pat. Off. | C10M 129/54 |

OTHER PUBLICATIONS

Derwent Abstract AN–83–793531, date unavailable.

"Lubrizol Product Recommendations for Use in Greases", date unavailable.

Lubrizol® 5201 Grese Brochure, The Lubrizol Corporation, date unavailable.

NLGI Lubricating Grease Guide–Pages 1.05–1.20, 2.09–2.18, 3.01–3.28, 4.08–4.12 and i–xv, date unavailable.

*Primary Examiner*—Jacqueline V. Howard

*Attorney, Agent, or Firm*—Joseph P. Fischer; David M. Shold

[57] ABSTRACT

Improved grease compositions comprise a major amount of an oil based metal soap thickened base grease selected from the group consisting of simple metal soap thickened base grease, complex grease and failed complex grease, at least one metal salt of a sulfur and phosphorus containing acid, an overbased metal salt of an organic acid, a hydrocarbyl phosphite, and optionally, an aliphatic group substituted carboxylic acid, anhydride thereof and aliphatic group substituted lactone, wherein the aliphatic group contains at least about 8 carbon atoms in amounts sufficient to increase the dropping point of the base grease, as measured by ASTM Procedure D-2265 by at least 15° C.

57 Claims, No Drawings

GREASE COMPOSITIONS

FIELD OF THE INVENTION

This invention relates to grease compositions. More particularly, it relates to metal soap thickened base greases having dropping points as measured by ASTM Procedure D-2265 increased by adding certain components described in detail hereinbelow.

BACKGROUND OF THE INVENTION

Man's need to reduce friction dates to ancient times. As far back as 1400 BC, both mutton fat and beef fat (tallow) were used in attempts to reduce axle friction in chariots.

Until the mid-1800's, lubricants continued to be primarily mutton and beef fats, with certain types of vegetable oils playing minor roles. Since then, most lubricants, including greases, have been based on petroleum ("mineral") oil, although synthetic oil based lubricants are used for special applications.

In the *Lubricating Grease Guide*, ©1994, available from the National Lubricating Grease Institute, Kansas City, Mo., USA, is a detailed discussion of greases, including various types of thickeners. Such thickeners include simple metal soap, complex metal salt-metal soap and non-soap thickened greases.

Simple metal soap thickened greases have provided exemplary performance. However, under certain conditions an increased dropping point as measured by ASTM Procedure D-2265 is required.

One way to increase the dropping point of base greases is to convert a simple metal soap grease to a complex grease by incorporating therein certain acids, typically carboxylic acids such as acetic acid, alpha-omega-dicarboxylic acids and certain aromatic acids. This process necessarily adds complexity, consuming considerable time resulting in reduced production. Nevertheless, complex greases provide highly desirable properties and are widely used. Oftentimes complexing does not take place and the grease retains substantially the properties of the corresponding simple soap grease. Such greases are referred to herein as failed complex greases. Reasons for failure to achieve complex formation are not well understood.

Doner et al, in a series of U.S. Patents, specifically, U.S. Patents

| | | |
|---|---|---|
| 5,084,194 | 5,068,045 | 4,961,868 |
| 4,828,734 | 4,828,732 | 4,781,850 |
| 4,780,227 | 4,743,386 | 4,655,948 |
| 4,600,517 | 4,582,617 | |

teaches increased thickening of metal salt thickened base greases is obtained employing a wide variety of boron-containing compounds. Other additives contemplated for use with boron-containing compounds are phosphorus- and sulfur-containing materials, particularly zinc dithiophosphates.

Reaction products of 0,0-dihydrocarbyl-phosphorodithioic acids with epoxides are described by Asseff in U.S. Pat. No. 3,341,633. These products are described as gear lubricant additives and as intermediates for preparing lubricant additives.

U.S. Pat. No. 3,197,405 (LeSuer) describes phosphorus and nitrogen containing compositions prepared by forming an acidic intermediate by the reaction of a hydroxy substituted triester of a phosphorothioic acid with an inorganic phosphorus reagent and neutralizing a substantial portion of said acidic intermediate with an amine. These compositions are described as lubricant additives.

U.S. Pat. No. 4,410,435 (Naka et al) teaches a lithium complex grease containing a base oil, a fatty acid having 12–24 carbon atoms, a dicarboxylic acid having 4–12 carbon atoms and/or a dicarboxylic acid ester and lithium hydroxide thickened with a phosphate ester and/or a phosphite ester.

U.S. Pat. No. 5,256,321 (Todd) relates to improved grease compositions comprising a major amount of an oil-based simple metal soap thickened base grease and minor amounts of a phosphorus and sulfur containing composition to increase the dropping point of the base grease.

U.S. Pat. No. 5,236,320 (Todd et al), relates to improved grease compositions comprising a phosphorus and sulfur containing composition, an overbased metal salt of an organic acid and a hydrocarbyl phosphite.

Commonly owned, copending U.S. patent application Ser. No. 09/082402 filed May 20, 2998, relates to metal soap thickened base greases comprising a phosphorus and sulfur containing composition, an overbased metal salt of an organic acid, a hydrocarbyl phosphite and a hydrocarbyl substituted carboxylic acid or anhydride thereof.

U.S. Pat. No. 5,362,409 (Wiggins et al) relates to improved grease compositions selected from the group consisting of complex greases and failed complex greases comprising a phosphorus and sulfur containing composition, alone or together with an overbased metal salt of an organic acid and a hydrocarbyl phosphite U.S. Pat. No. 5,472,626 describes a lubricating grease composition comprising 12-hydroxy lithium calcium stearate.

It has been discovered that the response of base greases to dropping point improving additives is frequently dependent upon the viscosity index of the oil used to prepare the grease, with low viscosity index and medium viscosity index oils being less responsive. It has also been discovered that the response of base greases to dropping point improving additives is frequently dependent upon the way the base grease is prepared, with greases prepared in equipment open to the atmosphere being less responsive to dropping point improving additives than greases prepared in closed systems.

While not directly related to the performance characteristics of the grease, it has been observed that some sulfur and phosphorus containing materials, when used in amounts needed to improve the dropping point of a grease, impart an odor to the finished grease. In some cases, this odor is considered objectionable.

The instant invention addresses and solves these problems.

SUMMARY OF THE INVENTION

This invention relates to improved metal soap thickened base greases, the improvement arising from incorporation therein of certain additives compared to the greases without the additional additives.

In one embodiment this invention relates to improved grease compositions comprising a major amount of an oil-based, simple metal soap thickened base grease and (A) from about 0.25% to about 10% by weight of an overbased metal salt of an organic acid other than a phosphorus- and sulfur- containing acid;

(B) from about 0.25% to about 5% by weight of a metal salt of a phosphorus and sulfur containing acid wherein the acid is selected from the group consisting of compounds represented by the formula (I)

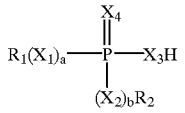

wherein each $X_i$, $X_2$, $X_3$ and $X_4$ is independently oxygen or sulfur provided at least one is sulfur; each a and b is independently 0 or 1; and wherein each member of the group consisting of $R_1$ and $R_2$ is, independently, selected from hydrogen and hydrocarbyl; and (C) from about 0.25% to about 5% by weight of a hydrocarbyl phosphite wherein the dropping point of the improved grease composition is at least about 15° C. greater than that of the base grease as measured by ASTM procedure D-2265.

In another embodiment this invention relates to improved grease compositions wherein the base grease is a complex or failed complex base grease.

In yet another embodiment, the grease composition further comprises (D) from about 0.025% to about 2% by weight of at least one of an aliphatic group substituted carboxylic acid, an anhydride thereof and an aliphatic group substituted lactone, wherein the aliphatic group contains at least about 8 carbon atoms.

In one further embodiment, this invention is directed to a grease composition having a dropping point greater than 260° C. prepared from a base grease having a dropping point less than 260° C.

The present invention also is directed to methods for increasing the dropping point of greases.

The greases of this invention are useful for lubricating, sealing and protecting mechanical components such as gears, axles, bearings, shafts, hinges and the like. Such mechanical components are found in automobiles, trucks, bicycles, steel mills, mining equipment, railway equipment including rolling stock, aircraft, boats, construction equipment and numerous other types of industrial and consumer machinery.

DETAILED DESCRIPTION OF THE INVENTION

As used herein, the term "hydrocarbyl" or "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon groups. Substantially hydrocarbon describes groups, include hydrocarbon based groups, which contain non-hydrocarbon substituents, or non-carbon atoms in a ring or chain, which do not alter the predominantly hydrocarbon nature of the group.

Hydrocarbyl groups can contain up to three, typically up to two, more preferably up to one, non-hydrocarbon substituent or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkoxyl, alkyl mercapto, alkyl sulfoxy, etc. Usually, however, the hydrocarbyl groups are purely hydrocarbon and contain substantially no such non-hydrocarbon groups, substituents or heteroatoms.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is competed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Unless indicated otherwise, hydrocarbyl groups are substantially saturated. By substantially saturated it is meant that the group contains no more than one carbon-to-carbon unsaturated bond, olefinic unsaturation, for every ten carbon-to-carbon bonds present. Often, they contain no more than one carbon-to-carbon non-aromatic unsaturated bond for every 50 carbon-to-carbon bonds present. Frequently, hydrocarbyl groups are substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

Heat resistance of greases is measured in a number of ways. One measure of heat resistance is the dropping point. Grease typically does not have a sharp melting point but rather softens until it no longer functions as a thickened lubricant. The American Society for Testing and Materials (1916 Race Street, Philadelphia, Pa.) has set forth a test procedure, ASTM D-2265, which provides a means for measuring the dropping point of greases.

In general, the dropping point of a grease is the temperature at which the grease passes from a semisolid to a liquid state under the conditions of the test. The dropping point is the temperature at which the first drop of material falls from the test cup employed in the apparatus used in ASTM procedure D-2265.

For many applications simple metal soap thickened base greases are entirely satisfactory. However, for some applications, greater heat resistance manifested by a dropping point above that possessed by simple metal soap thickened greases is desirable.

All of the greases of this invention are metal soap greases; that is, the thickener component comprises a metal salt of a fatty acid.

Simple-metal soaps are the substantially stoichiometrically neutral metal salts of fatty acids. By substantially stoichiometrically neutral is meant that the metal salt contains from about 90% to about 110% of the metal required to prepare the stoichiometrically neutral salt, preferably from about 95% to about 105%, more often to about 100%. Greases thickened with only these metal salts are simple metal salt thickened greases.

It is often desirable to increase the dropping point of simple metal soap thickened base greases. It also is desirable to bring failed complex greases up to successful complex grease standards and it is often desirable to provide a means to further increase dropping points of complex grease compositions. The preferred minimum dropping point of the greases of this invention is 260° C. Thus, when a grease has a dropping point less than 260° C., it is often desirable to increase the dropping point of the grease so that it meets the preferred minimum dropping point of 260° C.

Thus, it is an object of this invention to provide novel grease compositions.

It is a further object of this invention to provide grease compositions having valuable properties.

It is another object of this invention to provide grease compositions having improved thermal (heat) stability as indicated by an increased dropping point as measured by ASTM Procedure D-2265.

Another object is to provide a method for bringing failed complex base greases up to complex grease standards.

A further object is to provide a method for increasing the dropping point of complex greases to levels exceeding that of the base complex grease.

Other objects will become apparent to the skilled person upon reading the specification and description of this invention.

The grease compositions of this invention display dropping points greater than the dropping point of the corresponding base grease. This benefit is obtained by incorporating into a base grease a metal salt of certain sulfur and phosphorus containing compositions, a metal overbased organic acid and a hydrocarbyl phosphite in amounts sufficient to increase the dropping point of the corresponding base grease as-measured by ASTM Procedure D-2265.

In another embodiment, the grease composition further comprises at least one of an aliphatic group substituted carboxylic acid, an anhydride thereof and an aliphatic group substituted lactone, wherein the aliphatic group contains at least about 8 carbon atoms.

Base greases of this invention are prepared by thickening an oil basestock. The greases of this invention are oil-based, that is, they comprise an oil which has been thickened with a metal soap.

Complex metal soap greases provide increased dropping point compared to corresponding simple metal soap thickened greases. Complex thickeners involve in addition to a fatty acid component, a non-fatty acid, e.g., benzoic, lower aliphatic, organic dibasic acids, etc. component. By lower aliphatic is meant $C_1$–$C_7$ aliphatic. From time to time attempts to form complex greases fail, resulting in a grease having substantially the same dropping point as the corresponding simple metal soap thickened grease, or at least a dropping point lower than desired. Failure usually is manifested by a dropping point significantly (e.g., often 20–50° C. or more) lower than that displayed by the successful complex grease.

Complex greases are formed by reaction of a metal-containing reagent with two or more acids. One of the acids is a fatty acid or reactive derivative thereof and the other is an aromatic acid such as benzoic acid, an alpha-omega dicarboxylic acid such as azelaic acid, or a lower carboxylic acid such as acetic acid and the like. The metal soap is the salt of the fatty acid and the non-fatty acid is the complexing agent.

A common procedure for preparing complex grease is carried out in two steps, the normal (simple) soap is formed first then it is complexed by reaction with the second acid. Alternatively the complex grease may be formed by reacting a mixture of the acids with the metal reagent. As stated above, the acid reactants may be reactive derivatives of the acid, such as esters. The reaction is typically conducted in a portion of the oil base and the remainder of the oil is added after complexation is completed. This permits more rapid cooling of the grease allowing subsequent processing, such as milling, to be conducted soon after the grease is formed.

There is no absolute industry standard for the dropping point of a complex grease. However, it is often accepted that minimum dropping points of about 260° C. are displayed by complex greases. However, a more general definition of a complex grease is one which is prepared as described hereinabove and which displays a dropping point significantly higher, typically at least about 20° C. higher, often at least about 40° C. higher, than the corresponding simple metal soap grease.

As noted herein, the dropping point of a failed complex grease is usually about the same as that of the corresponding simple metal soap grease.

It can be concluded, then, that a metal soap contributes to the thickening of both the successful and failed complex grease. Thus, both the successful complex grease and the failed complex grease are referred to herein as metal soap thickened greases, but are distinguished from simple metal soap greases as defined herein.

The grease compositions of this invention employ an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubrication Engineering*, volume 43, pages 184–185, March 1987. This article is incorporated herein by reference for its disclosures relating to lubricating oils. A description of oils of lubricating viscosity occurs in U.S. Pat. No. 4,582,618 (Davis) (column 2, line 37 through column 3, line 63, inclusive), incorporated herein by reference for its disclosure to oils of lubricating viscosity.

Another source of information regarding oils used to prepare lubricating greases is *NLGI Lubricating Grease Guide*, National Lubricating Grease Institute, Kansas City, Mo. (1994), pp 1.06–1.09, which is expressly incorporated herein by reference.

As noted hereinabove, the viscosity index of the oil from which the base grease is derived has an effect upon the response to a number of known additive systems which are designed to improve dropping points. In particular, low viscosity index (LVI) and medium viscosity index (MVI) oils, sometimes referred to in the art as mid-range viscosity index oils, are unresponsive to many additives systems which are intended to increase dropping points. MVI oils have viscosity indices from about 50 up to about 85 as determined employing the procedure set out in ASTM Standard D-2270. LVI oils have viscosity index less than 50 and high viscosity index (HVI) oils have viscosity index greater than 85, typically from about 95 to about 110. Oils having viscosity index greater than 110 are often referred to as very high viscosity index (VHVI) and extra high viscosity index (XHVI) oils. These commonly have viscosity index ranging from 120 to 140. ASTM Procedure D-2270 provides a means for calculating Viscosity Index from kinematic viscosity at 40° C. and at 100°0C.

The metal soap portions of the greases of this invention are well-known in the art. These metal soaps are present in a base oil, typically an oil of lubricating viscosity in amounts, typically from about 1 to about 30% by weight, more often from about 1 to about 15% by weight, of the base grease composition. In many cases, the amount of metal soap used to thicken the base oil constitutes from about 5% to about 25% by weight of base grease. In other cases from about 2% to about 15% by weight of metal soap is present in the base grease.

The specific amount of metal soap required often depends on the metal soap employed. The type and amount of metal soap employed is frequently dictated by the desired nature of the grease.

The type and amount of metal soap to use is also dictated by the desired consistency, which is a measure of the degree to which the grease resists deformation under application of force. Consistency is usually indicated by the ASTM Cone penetration test, ASTM D-217 or ASTM D-1403.

Types and amounts of metal soap thickeners to employ are well-known to those skilled in the grease art. The aforementioned *Lubricating Grease Guide*, pp 1.09–1.12 and 1.14–1.17 provides a description of metal soap thickeners and soap complexes. This text is hereby incorporated herein by reference for its disclosure of metal soap grease thickeners.

As indicated hereinabove the grease compositions of this invention are oil based, including both natural and synthetic oils. Greases are made from these oils by incorporating a thickening agent therein. Thickening agents useful in the greases of this invention are the metal soaps, the substantially stoichiometrically neutral metal salts of fatty acids.

Fatty acids are defined herein as carboxylic acids containing from about 8 to about 24, preferably from about 12 to about 18 carbon atoms. The fatty acids are usually monocarboxylic acids. Examples of useful fatty acids are capric, palmitic, stearic, oleic and others. Mixtures of acids are useful. Preferred carboxylic acids are linear; that is they are substantially free of hydrocarbon branching.

Particularly useful acids are the hydroxy-substituted fatty acids such as hydroxy stearic acid wherein one or more hydroxy groups may be located at internal positions on the carbon chain, such as 12-hydroxy-, 14-hydroxy-, etc. stearic acids.

While the soaps are fatty acid salts and frequently are prepared directly from fatty acids, they may be prepared by saponification of a fat which is often a glyceride or other ester such as methyl or ethyl esters of fatty acids, preferably methyl esters, which saponification is generally conducted in situ in the base oil making up the grease.

Whether the grease is prepared from acids or esters, greases are usually prepared in a grease kettle or other reactor such as described by K. G. Timm in "Grease Mixer Design", *NLGI Spokesman*, June, 1980. Such other reactors include contactors and continuous grease-forming reactors. One process is the Texaco Continuous Grease Process which is discussed by Green et al in *NLGI Spokesman*, pp. 368–373, January, 1969, and by Witte, et al, in *NLGI Spokesman* pp. 133–136 (July, 1980). U.S. Pat. No. 4,392,967 relates to a process for continuously manufacturing lubricating grease.

As noted herein, the response of base greases to dropping point improving additive systems often depends upon the oil used to prepare the base grease and upon the method of preparation.

Low viscosity index and medium viscosity index oils are generally resistant to these additive systems, without regard to method of preparation of the base grease. On the other hand, base greases derived from the high viscosity index oils are generally responsive to dropping point improving additive systems of the prior art when the grease is prepared in a closed system, such as a contactor. On the other hand, greases derived from high viscosity index oils are generally not responsive to prior art dropping point additive systems when prepared in an open system.

It has been discovered that the dropping point improving additive systems of this invention do provide increased dropping point of the base grease, without regard to the oil used to prepare the grease or to method of grease formation.

The mixture of base oil, fat, ester, fatty acid or non-fatty acid and metal-containing reactant react to form the soap in-situ. As mentioned hereinabove, complexing acids or reactive derivatives thereof may be present during soap formation or may be incorporated afterwards. Additives for use in the grease may be added during grease manufacture, but are often added following formation of the base grease.

The metals of the metal soap greases of this invention are typically alkali metals, alkaline earth metals, titanium and aluminum. For purposes of cost and ease of processing, the metals are incorporated by reacting the acid reactants with basic metal containing reactants such as oxides, hydroxides, carbonates and alkoxides (typically lower alkoxides, those containing from 1 to 7 carbon atoms in the alkoxy group). The soap and complex salts may also be prepared from the metal itself although many metals are either too reactive or insufficiently reactive with the fat, ester or fatty acid to permit convenient processing.

As stated hereinabove, complex greases are prepared from a mixture of acids, one of which is a fatty acid and one which is not a fatty acid as defined herein. The non-fatty acid may be incorporated at any stage of the thickener formation.

Preferred metals are lithium, sodium, calcium, magnesium, barium and aluminum. Especially preferred are lithium, sodium and calcium; lithium is particularly preferred. Mixtures may be used.

Preferred fatty acids are tallow, soy, stearic, palmitic, oleic and their corresponding esters, including glycerides (fats) for example, lard oil. Hydroxy-substituted fatty acids and the corresponding esters, including fats are particularly preferred. 12-Hydroxy stearic acid is particularly preferred.

Preferred non-fatty acids employed in formation of complex greases include aromatic, lower aliphatic and dibasic acids. Representative examples are benzoic acid, acetic acid and azelaic acid.

These and other thickening agents are described in U.S. Pat. Nos. 2,197,263; 2,564,561 and 2,999,066, and the aforementioned *Lubricating Grease Guide*, all of which are incorporated herein by reference for relevant disclosures of grease thickeners.

Complex greases, e.g., those containing metal soap-salt complexes such as metal soap-acetates, metal soap-dicarboxylates, etc. are not simple metal soap thickened greases.

For reasons which are not well-understood, complexation is sometimes not successful. Thus, although the processing is expected to and usually does, attain enhanced thermal properties of a complex grease, sometimes only a slight or no increase in dropping point is obtained. Such greases are described herein by the expression "failed complex" grease.

For the purposes of this invention, both successful complex greases and failed complex as well as simple metal-soap thickened base greases are grouped within the class of "metal soap thickened greases". Failed complex greases and simple metal soap thickened base greases are referred to as such, and successful complex greases are referred to as complex greases.

The thickeners of all of these types greases are referred to herein as metal soap thickeners. It is to be understood that the metal soap thickener of the failed grease is not a simple metal soap but, as evidenced by its inability to cause complex grease formation it obviously does not possess the same characteristics as does the metal salt complex of the successful complex grease. The distinction lies in the high temperature properties of the resulting grease composition.

(A) The Overbased Metal Salt of an Organic Acid

Component (A) is an overbased metal salt of an organic acid other than a phosphorus- and sulfur-containing acid. The overbased materials are characterized by metal content in excess of that which would be present according to the stoichiometry of the metal and organic acid reactant. The amount of excess metal is commonly reported in terms of metal ratio. The term "metal ratio" (abbreviated MR) is the ratio of the equivalents of metal base to the equivalents of the organic acid substrate. A neutral salt has a metal ratio of one. Overbased materials have metal ratios greater than 1, typically from 1.1 to about 40 or more.

In the present invention, preferred overbased materials have MR from about 1.1 to about 25, with MR of from about 1.5 to about 20 being more preferred, and MR of from 5 to 15 even more preferred.

Preferred are Group I, the alkali metal, and Group II, the alkaline earth metal, (Chemical Abstracts (CAS)) version of the Periodic Table of the Elements) and zinc salts. Most preferred are sodium, magnesium and calcium, with calcium being especially preferred.

Generally, overbased materials useful in the present invention are prepared by treating a reaction mixture comprising an organic acid, a reaction medium comprising at least one solvent, a stoichiometric excess of a basic metal compound and a promoter with an acidic material, typically carbon dioxide. In some cases, particularly when the metal is magnesium, the acidic material may be replaced with water.

Organic Acids

Organic acids useful in making the overbased salts of the present invention include carboxylic acid, sulfonic acid, phosphorus-containing acid, phenol or mixtures of two or more thereof.

Carboxylic Acids

The carboxylic acids useful in making the salts (A) may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids. Throughout this specification and in the appended claims, any reference to carboxylic acids is intended to include the acid-producing derivatives thereof such as anhydrides, lower alkyl esters, acyl halides, lactones and mixtures thereof unless otherwise specifically stated.

The carboxylic acids are preferably oil-soluble and the number of carbon atoms present in the acid is important in contributing to the desired solubility. Usually, in order to provide the desired oil-solubility, the number of carbon atoms in the carboxylic acid should be at least about 8, more preferably about 12, more preferably at least about 18, even more preferably up to about 30. Generally, these carboxylic acids do not contain more than about 400 carbon atoms per molecule, preferably no more than about 100, often no more than about 50.

The lower molecular weight monocarboxylic acids contemplated for making the overbased metal salts for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference.

Examples of lower molecular weight polycarboxylic acids include dicarboxylic acids and derivatives such as sebacic acid, cetyl malonic acid, tetrapropylene-substituted succinic anhydride, etc. Lower alkyl esters of these acids can also be used.

The monocarboxylic acids include isoaliphatic acids. Such acids often contain a principal chain having from about 14 to about 20 saturated, aliphatic carbon atoms and at least one, but usually no more than about four, pendant acyclic lower alkyl groups. Specific examples of such isoaliphatic acids include 10-methyl-tetradecanoic acid, 3-ethyl-hexadecanoic acid, and 8-methyl-octadecanoic acid.

Isoaliphatic acids include mixtures of branch-chain acids prepared by the isomerization of commercial fatty acids (e.g. oleic, linoleic or tall oil acids) of, for example, about 16 to about 20 carbon atoms.

The higher molecular weight mono- and polycarboxylic acids suitable for use in making the salts (A) are well known in the art and have been described in detail, for example, in the following U.S., British and Canadian patents: U.S. Pat. Nos. 3,024,237; 3,172,892; 3,219,666; 3,245,910; 3,271,310; 3,272,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133; British Patents 944,136; 1,085,903; 1,162,436; and 1,440,219; and Canadian Patent 956,397. These patents are incorporated herein by references for their disclosure of higher molecular weight mono- and polycarboxylic acids and methods for making the same.

A group of useful aromatic carboxylic acids are those of the formula (VII)

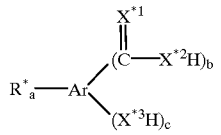

wherein in Formula VII, R* is an aliphatic hydrocarbyl group of preferably about 4 to about 400 carbon atoms, a is a number in the range of zero to about 4, Ar is an aromatic group, $X^{*1}$, $X^{*2}$ and $X^{*3}$ are independently sulfur and oxygen, b is a number in the range of from 1 to about 4, c is a number in the range of 1 to about 4, usually 1 to 2, with the proviso that the sum of a, b and c does not exceed the number of valences of Ar. Preferably, R* and a are such that there is an average of at least about 8 aliphatic carbon atoms provided by the R* groups in each compound represented by Formula VII.

The aromatic group Ar in Formula VII may have the same structure as any of the aromatic groups Ar discussed below under the heading "Phenols". Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Examples of the R* groups in Formula VII include butyl, isobutyl, pentyl, octyl, nonyl, dodecyl, and substituents derived from polymerized olefins such as polyethylenes, polypropylenes, polyisobutylenes, ethylene-propylene copolymers, oxidized ethylene-propylene copolymers, and the like.

Within this group of aromatic acids, a useful class of carboxylic acids are those of the formula (VIII)

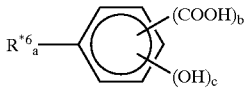

wherein in Formula VIII, $R^{*6}$ is an aliphatic hydrocarbyl group preferably containing from about 4 to about 400 carbon atoms, a is a number in the range of from zero to about 4, preferably 1 to about 3; b is a number in the range of 1 to about 4, preferably 1 to about 2, c is a number in the range of 1 to about 4, preferably 1 to about 2, and more preferably 1; with the proviso that the sum of a, b and c does not exceed 6. Preferably, $R^{*6}$ and a are such that the acid molecules contain at least an average of about 12 aliphatic carbon atoms in the aliphatic hydrocarbon substituents per acid molecule.

Included within the class of aromatic carboxylic acids (VIII) are the aliphatic hydrocarbon-substituted salicylic acids wherein each aliphatic hydrocarbon substituent contains an average of at least about 8 carbon atoms per substituent and 1 to 3 substituents per molecule. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbons atoms are particularly useful.

The aromatic carboxylic acids corresponding to Formulae VII and VIII above are well known or can be prepared according to procedures known in the art. Carboxylic acids of the type illustrated by these formulae and processes for preparing their neutral and basic metals salts are well known and disclosed, for example, in U.S. Pat. Nos. 2,197,832; 2,197,835; 2,252,662; 2,252,664; 2,714,092; 3,410,798; and 3,595,791.

Sulfonic Acids

The sulfonic acids useful in making salts (A) used in the compositions of this invention include the sulfonic and thiosulfonic acids. Substantially neutral metal salts of sulfonic acids are also useful for preparing the overbased metal salts (A).

The sulfonic acids include the mono-or poly-nuclear aromatic or cycloaliphatic compounds. The oil-soluble sulfonic acids can be represented for the most part by the following formulae:

$$R^{\#1}_a—T—(SO_3H)_b \quad (IX)$$

$$R^{\#2}—(SO_3H)_a \quad (X)$$

T is a cyclic nucleus such as, for example, benzene, naphthalene, anthracene, diphenylene oxide, diphenylene sulfide, petroleum naphthenes, etc. $R^{\#1}$ preferably is an aliphatic group such as alkyl, alkenyl, alkoxy, alkoxyalkyl, etc.; a is at least 1, and $R^{\#1}_a$—T contains a total of at least about 14 carbon atoms. When $R^{\#2}$ is an aliphatic group it usually contains at least about 15 carbon atoms. When it is an aliphatic-substituted cycloaliphatic group, the aliphatic groups usually contain a total of at least about 12 carbon atoms. $R^{\#2}$ is preferably alkyl, alkenyl, alkoxyalkyl, carboalkoxyalkyl, etc. Specific examples of $R^{\#1}$ and $R^{\#2}$ are groups derived from petrolatum, saturated and unsaturated paraffin wax, and polyolefins, including polymerized, $C_2$, $C_3$, $C_4$, $C_5$, $C_6$, etc., olefins containing from about 15 to 700 or more carbon atoms. The groups T, $R^{\#1}$, and $R^{\#2}$ can also contain other inorganic or organic substituents in addition to those enumerated above such as, for example, hydroxy, mercapto, halogen, nitro, amino, nitroso, sulfide, disulfide, etc. In Formula IX, a and b are at least 1, and likewise in Formula X, a is at least 1.

Specific examples of oil-soluble sulfonic acids are mahogany sulfonic acids; bright stock sulfonic acids; sulfonic acids derived from lubricating oil fractions; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons) such as sulfonic acid, cetylphenol mono-sulfide sulfonic acids, dilauryl naphthyl sulfonic acids, and alkaryl sulfonic acids such as dodecyl benzene "bottoms" sulfonic acids.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by product from the manufacture of household detergents. Similar products obtained from alkylation bottoms formed during manufacture of linear alkyl sulfonates (LAS) are also useful in making the sulfonates used in this invention.

The production of sulfonates from detergent manufactured byproducts by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, New York (1969).

Illustrative examples of these sulfonic acids include polybutene or polypropylene substituted naphthalene sulfonic acids, sulfonic acids derived by the treatment of polybutenes have a number average molecular weight (n) in the range of 700 to 5000, preferably 700 to 1200, more preferably about 1500 with chlorosulfonic acids, paraffin wax sulfonic acids, polyethylene (n equals about 900–2000, preferably about 900–1500, more preferably 900–1200 or 1300) sulfonic acids, etc. Preferred sulfonic acids are mono-, di-, and tri-alkylated benzene (including hydrogenated forms thereof) sulfonic acids.

Also included are aliphatic sulfonic acids such as paraffin wax sulfonic acids, unsaturated paraffin wax sulfonic acids, hydroxy-substituted paraffin wax sulfonic acids, polyisobutene sulfonic acids wherein the polyisobutene contains from 20 to 7000 or more carbon atoms, chloro-substituted paraffin wax sulfonic acids, etc.; cycloaliphatic sulfonic acids such as petroleum naphthene sulfonic acids, lauryl cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

The basic (overbased) salts of the above-described synthetic and petroleum sulfonic acids are useful in the practice of this invention.

Phenols

The phenols useful in making the salts (A) used in the compositions of this invention can be represented by the formula $$R^{\#3}{}_a\text{—Ar—}(OH)_b \qquad \text{(XI)}$$

wherein in Formula XI, $R^{\#3}$ is a hydrocarbyl group of from about 4 to about 400 carbon atoms; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R^{\#3}$ and a are preferably such that there is an average of at least about 8 aliphatic carbon atoms provided by the $R^{\#3}$ groups for each phenol compound represented by Formula XI.

While the term "phenol" is used herein, it is to be understood that this term is not intended to limit the aromatic group of the phenol to benzene. Accordingly, it is to be understood that the aromatic group as represented by "Ar" in Formula XI, as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b in Formula XI. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The $R^{\#3}$ group in Formula XI is a hydrocarbyl group that is directly bonded to the aromatic group Ar. $R^{\#3}$ preferably contains about 6 to about 80 carbon atoms, preferably about 6 to about 30 carbon atoms, more preferably about 8 to about 25 carbon atoms, and advantageously about 8 to about 15 carbon atoms. Examples of $R^{\#3}$ groups include butyl, isobutyl, pentyl, octyl, nonyl, dodecyl, 5-chlorohexyl, 4-ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylenepropylene copolymers, propylene tetramer and tri(isobutene).

Metal Compounds

The metal compounds useful in making the overbased metal salts of the organic acids are generally basic metal compounds capable of forming salts with the organic acids, often oxides, hydroxides, carbonates, alkoxides, etc. Group I or Group II metal compounds (CAS version of Periodic Table of the Elements) and preferred. The Group I metals of the metal compound include alkali metals (sodium, potassium, lithium, etc.) as well as Group IB metals such as copper. The Group I metals are preferably sodium, potassium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, more preferably calcium.

Acidic Materials

An acidic material as defined hereinbelow, is often used to accomplish the formation of the overbased salt. The acidic material may be a liquid such as formic acid, acetic acid, nitric acid, sulfuric acid, etc. Acetic acid is particularly useful. Inorganic acidic materials may also be used such as HCl, $H_3BO_3$, $SO_2$, $SO_3$, $CO_2$, $H_2S$, etc., carbon dioxide being preferred. A preferred combination of acidic materials is carbon dioxide and acetic acid.

Promoter

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, phenolic substances such as phenols and naphthols, amines such as aniline and dodecyl amine and mono- and polyhydric alcohols of up to about 30 carbon atoms. A comprehensive discussion of promoters is found in U.S. Pat. Nos. 2,777,874; 2,695,910; 2,616,904; 3,384,586 and 3,492,231. These patents are incorporated herein by reference for their disclosure of promoters. Especially useful are the monohydric alcohols having up to about 10 carbon atoms, mixtures of methanol with higher monohydric alcohols and phenolic materials.

Patents specifically describing techniques for making basic salts of the hereinabove-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. The disclosures of these patents are hereby incorporated in this present specification for their disclosures in this regard as well as for their disclosure of specific suitable basic metal salts.

As indicated hereinabove, the acidic material (e.g. $CO_2$, acetic acid, etc.) may be replaced with water. The resulting overbased salts are described as hydrated. These products are most often magnesium overbased compositions. U.S. Pat. No. 4,094,801 (Forsberg) and U.S. Pat. No. 4,627,928 (Karn) describe such compositions and methods for making same. These patents are expressly incorporated herein for relevant disclosures of hydrated overbased metal salts of organic acids.

A large number of overbased metal salts are available for use in the compositions of this invention. Such overbased salts are well known to those skilled in the art. The following Examples are provided to illustrates types of overbased materials. These illustrations are not intended to limit the scope of the claimed invention. Unless indicated otherwise, all parts are parts by weight, temperatures are in degrees Celsius and filtrations are conducted using a diatomaceous earth filter aid.

EXAMPLE A-1

A mixture of 906 grams of an oil solution of an alkyl phenyl sulfonic acid (having an average molecular weight of 450, vapor phase osmometry), 564 grams mineral oil, 600 grams toluene, 98.7 grams magnesium oxide and 120 grams water is blown with carbon dioxide at a temperature of 78–85° C. for 7 hours at a rate of about 3 cubic feet of carbon dioxide per hour. The reaction mixture is constantly agitated throughout the carbonation. After carbonation, the reaction mixture is stripped to 165° C./20 torr and the residue filtered. The filtrate is an oil solution (34% oil) of the desired overbased magnesium sulfonate having a metal ratio of about 3.

EXAMPLE A-2

A mixture of 160 grams of blend oil, 111 grams of polyisobutenyl (number average molecular weight=950) succinic anhydride, 52 grams of n-butyl alcohol, 11 grams of water, 1.98 grams of Peladow (a product of Dow Chemical identified as containing 94–97% $CaCl_2$) and 90 grams of hydrated lime are mixed together. Additional hydrated lime is added to neutralize the subsequently added sulfonic acid, the amount of said additional lime being dependent upon the acid number of the sulfonic acid. An oil solution (1078 grams, 58% by weight of oil) of a straight chain dialkyl benzene sulfonic acid (molecular weight=430) is added with the temperature of the reaction mixture not exceeding 79° C. The temperature is adjusted to 60° C. The reaction product of heptyl phenol, lime and formaldehyde (64.5 grams), and 217 grams of methyl alcohol are added. The reaction mixture is blown with carbon dioxide to a base number (phenolphthalein) of 20–30. Hydrated lime (112 grams) is added to the reaction mixture, and the mixture is blown with carbon dioxide to a base number (phenolphthalein) of 45–60, while maintaining the temperature of the reaction mixture at 46–52° C. The latter step of hydrated lime addition followed by carbon dioxide blowing is repeated three more times with the exception with the last repetition the reaction mixture is carbonated to a base number (phenolphthalein) of 45–55. The reaction mixture is flash dried at 93–104° C., kettle dried at 149–160° C., filtered and adjusted with oil to a 12.0% Ca level. The product is an overbased calcium sulfonate having, by analysis, a base number (bromophenol blue) of 300, a metal content of 12.0% by weight, a metal ratio of 12, a sulfate ash content of 40.7% by weight, and a sulfur content of 1.5% by weight. The oil content is 53% by weight.

EXAMPLE A-3

A reaction mixture comprising 135 grams mineral oil, 330 grams xylene, 200 grams (0.235 equivalent) of a mineral oil solution of an alkylphenyl-sulfonic acid (average molecular weight 425), 19 grams (0.068 equivalent) of tall oil acids, 60 grams (about 2.75 equivalents) of magnesium oxide, 83 grams methanol, and 62 grams water is carbonated at a rate of 15 grams of carbon dioxide per hour for about two hours at the methanol reflux temperature. The carbon dioxide inlet rate is then reduced to about 7 grams per hour, and the methanol is removed by raising the temperature to about 98° C. over a three hour period. Water (47 grams) is added and carbonation is continued for an additional 3.5 hours at a temperature of about 95° C. The carbonated mixture is then stripped by heating to a temperature of 140°–145° C. over a 2.5 hour period. This results in an oil solution of a basic magnesium salt characterized by a metal ratio of about 10.

The carbonated mixture is cooled to about 60–65° C., and 208 grams xylene, 60 grams magnesium oxide, 83 grams methanol and 62 grams water are added thereto. Carbonation is resumed at a rate of 15 grams per hour for two hours at the methanol reflux temperature. The carbon dioxide additional rate is reduced to 7 grams per hour and the methanol is removed by raising the temperature to about 95° C. over a three hour period. An additional 41.5 grams of water are added and carbonation is continued at 7 grams per hour at a temperature of about 90–95° C. for 3.5 hours. The carbonated mass is then heated to about 150–160° C. over a 3.5 hour period and then further stripped by reducing the pressure to 20 mm. (Hg.) at this temperature. The carbonated reaction product is filtered, and the filtrate is an oil-solution of the desired basic magnesium salt characterized by a metal ratio of about 20.

EXAMPLE A-4

A mixture of 835 grams of 100 neutral mineral oil, 118 grams of a polybutenyl (molecular weight=950)-substituted succinic anhydride, 140 grams of a 65:35 molar mixture of isobutyl alcohol and amyl alcohol, 43.2 grams of a 15% calcium chloride aqueous solution and 86.4 grams of lime is prepared. While maintaining the temperature below 80° C., 1000 grams of an 85% solution of a primary mono-alkyl benzene sulfonic acid, having a molecular weight of about 480, a neutralization acid number of 110, and 15% by weight of an organic diluent is added to the mixture. The mixture is dried at 150° C. to about 0.7% water. The mixture is cooled to 46–52° C. where 127 grams of the isobutyl-amyl alcohol mixture described above, 277 grams of methanol and 87.6 grams of a 31% solution of calcium, formaldehyde-coupled, heptylphenol having a metal ratio of 0.8 and 2.2% calcium are added to the mixture. Three increments of 171 grams of lime are added separately and carbonated to a neutralization base number in the range of 50–60. A fourth lime increment of 171 grams is added and carbonated to a neutralization base number of (phenolphthalein) 45–55. Approximately 331 grams of carbon dioxide are used. The mixture is dried at 150° C. to approximately 0.5% water. The reaction mixture is filtered and the filtrate is the desired product. The product contains, by analysis, 12% calcium and has a metal ratio of 11. The product contains 41% oil.

EXAMPLE A-5

A reactor is charged with 1122 grams (2 equivalents) of a polybutenyl-substituted succinic anhydride derived from a polybutene (Mn=1000, 1:1 ratio of polybutene to maleic acid), 105 grams (0.4 equivalent) of tetrapropenyl phenol, 1122 grams of xylene and 1000 grams of 100 neutral mineral oil. The mixture is stirred and heated to 80° C. under nitrogen, and 580 grams of a 50% aqueous solution of sodium hydroxide are added to the vessel over 10 minutes. The mixture is heated from 80° C. to 120° C. over 1.3 hours.

The reaction mixture is carbonated at 1 standard cubic foot per hour (scfh) while removing water by azeotropic reflux. The temperature rises to 150° C. over 6 hours while 300 grams of water is collected. (1) The reaction mixture is cooled to about 80° C. whereupon 540 grams of 50% aqueous solution of sodium hydroxide are added to the vessel. (2) The reaction mixture is heated to 140° C. over 1.7 hours and water is removed at reflux conditions. (3) The reaction mixture is carbonated at 1 standard cubic foot per hour (scfh) while removing water for 5 hours. Steps (1)–(3) are repeated using 560 grams of an aqueous sodium hydroxide solution. Steps (1)–(3) are repeated using 640 grams of an aqueous sodium hydroxide solution. Steps (1)–(3) are then repeated with another 640 grams of a 50% aqueous sodium hydroxide solution. The reaction mixture is cooled and 1000 grams of 100 neutral mineral oil are added to the reaction mixture. The reaction mixture is vacuum stripped to 115° C. at about 30 millimeters of mercury. The residue is filtered through diatomaceous earth. The filtrate has a total base number of 361, 43.4% sulfated ash, 16.0% sodium, 39.4% oil, a specific gravity of 1.11, and the overbased metal salt has a metal ratio of about 13.

EXAMPLE A-6

The overbased salt obtained in Example A-5 is diluted with mineral oil to provide a composition containing 13.75 sodium, a total base number of about 320, and 45% oil.

EXAMPLE A-7

A reactor is charged with 700 grams of a 100 neutral mineral oil, 700 grams (1.25 equivalents) of the succinic anhydride of Example A-5 and 200 grams (2.5 equivalents) of a 50% aqueous solution of sodium hydroxide. The reaction mixture is stirred and heated to 80° C. whereupon 66 grams (0.25 equivalent) of tetrapropenyl phenol are added to the reaction vessel. The reaction mixture is heated from 80° C. to 140° C. over 2.5 hours while blowing of nitrogen and removing 40 grams of water. Carbon dioxide (28 grams, 1.25 equivalents) is added over 2.25 hours at a temperature from 140–165° C. The reaction mixture is blown with nitrogen at 2 standard cubic foot per hour (scfh) and a total of 112 grams of water is removed. The reaction temperature is decreased to 115° C. and the reaction mixture is filtered through diatomaceous earth. The filtrate has 4.06% sodium, a total base number of 89, a specific gravity of 0.948, 44.5% oil, and the overbased salt has a metal ratio of about 2.

EXAMPLE A-8

A reactor is charged with 281 grams (0.5 equivalent) of the succinic anhydride of Example A-5, 281 grams of xylene, 26 grams of tetrapropenyl substituted phenol and 250 grams of 100 neutral mineral oil. The mixture is heated to 80° C. and 272 grams (3.4 equivalents) of an aqueous sodium hydroxide solution are added to the reaction mixture. The mixture is blown with nitrogen at 1 scfh, and the reaction temperature is increased to 148° C. The reaction mixture is then blown with carbon dioxide at 1 scfh for one hour and 25 minutes while 150 grams of water are collected. The reaction mixture is cooled to 80° C. whereupon 272 grams (3.4 equivalents) of the above sodium hydroxide solution are added to the reaction mixture, and the mixture is blown with nitrogen at 1 scfh. The reaction temperature is increased to 140° C. whereupon the reaction mixture is blown with carbon dioxide at 1 scfh for 1 hour and 25 minutes while 150 grams of water are collected. The reaction temperature is decreased to 100° C., and 272 grams (3.4 equivalents) of the above sodium hydroxide solution are added while blowing the mixture with nitrogen at 1 scfh. The reaction temperature is increased to 148° C., and the reaction mixture is blown with carbon dioxide at 1 scfh for 1 hour and 40 minutes while 160 grams of water are collected. The reaction mixture is cooled to 90° C. and 250 grams of 100 neutral mineral oil are added to the reaction mixture. The reaction mixture is vacuum stripped at 70° C. and the residue is filtered through diatomaceous earth. The filtrate contains 50.0% sodium sulfate ash by ASTM D-874, total base number of 408, a specific gravity of 1.18, 37.1% oil, and the salt has a metal ratio of about 15.8.

EXAMPLE A-9

A solution of 780 parts (1 equivalent) of an alkylated benzenesulfonic acid (57% by weight 100 neutral mineral oil and unreacted alkylated benzene) and 119 parts (0.2 equivalents) of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh (cubic feet per hour) for 11 minutes as the temperature slowly increases to 97° C. The rate of carbon dioxide flow is reduced to 6 cfh and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75.

EXAMPLE A-10

A blend is prepared of 135 parts of magnesium oxide and 600 parts of an alkylbenzenesulfonic acid having an equivalent weight of about 385, and containing about 24% unsulfonated alkylbenzene. During blending, an exothermic reaction takes place which causes the temperature to rise to 57° C. The mixture is stirred for one-half hour and then 50 parts of water is added. Upon heating at 95° C. for one hour, the desired magnesium oxide-sulfonate complex is obtained as a firm gel containing 9.07% magnesium.

EXAMPLE A-11

A reaction mixture comprising about 506 parts by weight of a mineral oil solution containing about 0.5 equivalent of a substantially neutral magnesium salt of an alkylated salicylic acid wherein the alkyl groups have an average of about 16 to 24 aliphatic carbon atoms and about 30 parts by weight of an oil mixture containing about 0.037 equivalent of an alkylated benzenesulfonic acid together with about 22 parts by weight (about 1.0 equivalent) of a magnesium oxide and about 250 parts by weight of xylene is added to a flask and heated to temperatures of about 60° C. to 70° C. The reaction is subsequently heated to about 85° C. and approximately 60 parts by weight of water are added to the reaction mass which is then heated to the reflux temperature. The reaction mass is held at the reflux temperature of about 95–100° C. for about 1½ hours and subsequently stripped at about 155° C., under 40 mm Hg, and filtered. The filtrate comprises the basic carboxylic magnesium salts and is characterized by a sulfated ash content of 15.59% (sulfated ash) corresponding to 274% of the stoichiometrically equivalent amount.

EXAMPLE A-12

A reaction mixture comprising approximately 1575 parts by weight of an oil solution containing about 1.5 equivalents of an alkylated 4-hydroxy-1,3-benzenedicarboxylic acid wherein the alkyl group has an average of at least about 16 aliphatic carbon atoms and an oil mixture containing about 0.5 equivalent of a tall oil fatty acid together with about 120 parts by weight (6.0 equivalents) of a magnesium oxide and about 700 parts by weight of an organic solvent containing xylene is added to a flask and heated to temperatures ranging from about 70–75° C. The reaction is subsequently heated to about 85° C. and approximately 200 parts by weight of water are added to the reaction which is then heated to the reflux temperature. The reaction mass is held at the reflux temperature of about 95–100° C. for about 3 hours and subsequently stripped at a temperature of about 155° C., under vacuum, and filtered. The filtrate comprises the basic carboxylic magnesium salts.

EXAMPLE A-13

A reaction mixture comprising approximately 500 parts by weight of an oil solution containing about 0.5 equivalent of an alkylated 1-hydroxy-2-naphthoic acid wherein the alkyl group has an average of at least about 16 aliphatic carbon atoms and an oil mixture containing 0.25 equivalent of a petroleum sulfonic acid together with about 30 parts by weight (1.5 equivalents) of a magnesium oxide and about 250 parts by weight of a hydrocarbon solvent is added to a reactor and heated to temperatures ranging to about 60–75° C. The reaction mass is subsequently heated to about 85°0C. and approximately 30 parts by weight of water are added to the mass which is then heated to the reflux temperature. The reaction mass is held at the reflux temperature of about 95°–100° C. for about 2 hours and subsequently stripped at a temperature of about 150° C., under vacuum, and filtered. The filtrate comprises the basic carboxylic magnesium metal salts.

EXAMPLE A-14

A calcium overbased salicylate is prepared by reacting in the presence of a mineral oil diluent a $C_{13-18}$ alkyl substituted salicylic acid with lime and carbonating in the presence of a suitable promoter such as methanol yielding a calcium overbased salicylate having a metal ratio of about 2.5. Oil content is about 38% by weight.

(B) The Metal Salts of Phosphorus and Sulfur Containing Acids

The grease compositions of the present invention comprise metal salts of phosphorus and sulfur containing acids. These include metal salts of (B-1) compounds represented by the formula

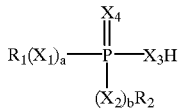

(I)

wherein each $X_1$, $X_2$, $X_3$ and $X_4$ is independently oxygen or sulfur provided at least one is sulfur; each a and b is independently 0 or 1; and wherein each member of the group consisting of $R_1$ and $R_2$ is independently selected from hydrogen and hydrocarbyl.

In a preferred embodiment, a and b are each 1.

In one embodiment, each of $R_1$ and $R_2$ is independently a hydrocarbyl group containing from 1 to about 30 carbon atoms.

In a particular embodiment, each of $R_1$ and $R_2$ is independently an alkyl group containing from 4 to about 24 carbon atoms or an aryl group containing from about 6 to about 18 carbon atoms, and more particularly each of $R_1$ and $R_2$ is independently a butyl, hexyl, heptyl, octyl, oleyl or cresyl group, including isomers thereof.

As mentioned hereinabove at least one of $X_1$, $X_2$, $X_3$ and $X_4$ must be sulfur while the remaining groups may be oxygen or sulfur. In one preferred embodiment, $X_4$ is sulfur, one of $X_1$, $X_2$ and $X_3$ is sulfur and the rest are oxygen.

The phosphorus and sulfur containing acids (B-1) include thiophosphoric acids including, but not limited to, dithiophosphoric as well as monothiophosphoric, thiophosphinic or thiophosphonic acids. The use of the term thiophosphoric, thiophosphonic or thiophosphinic acids is also meant to encompass monothio as well as dithio derivatives of these acids. Useful acids are described below. The di-organo thiophosphoric acid materials used to prepare the metal salts (B) used in this invention can be prepared by well known methods.

The S,S-di-organo tetrathiophosphoric acids can be prepared by the same method described above, except that mercaptans are employed in place of organic hydroxy compounds.

The O,S-di-organo trithiophosphoric acids can be prepared by the same manner employed in the preparation of the dithiophosphoric acids described above, except that a mixture of mercaptans and organic hydroxy compounds is reacted with phosphorus pentasulfide.

When a and b are 1, and one of $X_1$, $X_2$, $X_3$ or $X_4$ is sulfur and the rest are oxygen, the phosphorus-containing composition is characterized as a monothiophosphoric acid or monothiophosphate.

Monothiophosphoric acids may be characterized by one or more of the following formulae

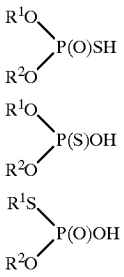

wherein $R^1$ and $R^2$ are defined as above, preferably each $R^1$ and $R^2$ is independently a hydrocarbyl group.

Monothiophosphates may be prepared by the reaction of a sulfur source such as sulfur, hydrocarbyl sulfides and polysulfides and the like and a dihydrocarbyl phosphite. The sulfur source is preferably elemental sulfur.

The preparation of monothiophosphates is disclosed in U.S. Pat. No. 4,755,311 and PCT Publication WO 87/07638 which are incorporated by reference for its disclosure of monothiophosphates, sulfur source for preparing monothiophosphates and the process for making monothiophosphates.

Monothiophosphates may be formed by adding a dihydrocarbyl phosphite to a composition containing a sulfur source. The phosphite may react with the sulfur source under blending conditions (i.e., temperatures from about 30° C. to about 100° C. or higher) to form monothiophosphate.

In Formula I, when a and b are 1; $X_1$ and $X_2$ are oxygen; and $X_3$ and $X_4$ are sulfur, the phosphorus-containing composition is characterized as a dithiophosphoric acid or phosphorodithioic acid.

Dithiophosphoric acids may be characterized by the formula (II)

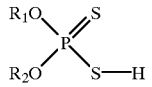

wherein $R_1$ and $R_2$ are as defined above. Preferably $R_1$ and $R_2$ are hydrocarbyl groups.

The dihydrocarbyl phosphorodithioic acids may be prepared by reaction of organic hydroxy compounds with $P_2S_5$, usually between the temperature of about 50° C. to about 150° C. Suitable organic hydroxy compounds include alcohols, such as, alkanols, alkanediols, cycloalkanols, alkyl- and cycloalkyl-substituted aliphatic alcohols, ether alcohols, ester alcohols and mixtures of alcohols; phenolic compounds, such as, phenol, cresol, xylenols, alkyl-substituted phenols, cycloalkyl-substituted phenols, phenyl-substituted phenols, alkoxy phenol, phenoxy phenol, naphthol, alkyl-substituted naphthols, etc. The non-benzenoid organic hydroxy compounds are generally the most useful in the preparation of the O,O-di-organo dithiophosphoric acids. A full discussion of the preparation of these compounds is in the Journal of the American Chemical Society, volume 67, (1945), page 1662. Preparation of dithiophosphoric acids and their salts is well known to those of ordinary skill in the art.

The metal salts of phosphorus and sulfur containing acids which are useful in this invention include Group I metals, Group II metals, aluminum, lead, copper, tin, manganese, molybdenum, cobalt, and nickel. Copper, molybdenum and zinc are especially preferred and zinc is particularly preferred. Examples of metal compounds which can be reacted with the phosphorus and sulfur containing acids are oxides, carbonates and hydroxides of the foregoing metals, for example, sodium hydroxide, calcium oxide, zinc oxide and hydroxide, etc.

Zinc is an especially preferred metal and zinc oxide is a particularly preferred metal compound.

In some cases, incorporation of certain ingredients such as small amounts of acetic acid or the metal acetate in conjunction with the metal compound will facilitate the reaction and result in an improved product. For example, the use of up to about 5% by weight of zinc acetate in combination with zinc oxide facilitate the formation of a zinc phosphorodithioate.

In an especially preferred embodiment, the metal salt (B) is a zinc salt of a phosphorodithioate of formula (II), wherein $R_1$ and $R_2$ are as described hereinabove.

The following examples illustrate types of sulfur- and phosphorus-containing compounds useful in the grease compositions of this invention. These examples are intended to be illustrative only and are not intended to limit the scope of the invention. Unless indicated otherwise, all parts are parts by weight, pressures are atmospheric, temperatures are in degrees Celsius and filtrations are conducted using a diatomaceous earth filter aid.

EXAMPLE B-1

A phosphorodithioic acid is prepared by reacting at 111° C., 457.7 parts of finely powdered phosphorus pentasulfide and 1000 parts of 4-methyl-2-pentanol yielding an acid having acid number of about 164, 9.5% P and 19.5% S. The resulting acid (1000 parts) is then added to a slurry containing 58.3 parts mineral oil and 130.2 parts zinc oxide at 80° C. with the evolution of water. When the neutralization is completed, remaining water and unreacted alcohol are vacuum stripped at 95° C. and the residue is filtered. The filtrate is further diluted with mineral oil to 8.5% P, 9.25% Zn and 17.6% S.

EXAMPLE B-2

A phosphorodithioic acid mixture is prepared by reacting 578.4 parts of finely powdered phosphorous pentasulfide and 1000 parts of an alcohol mixture containing about 26% by weight p-amyl alcohol, 61% by weight isobutanol and the balance a mixture of 2- and 3-methylbutanol. The reacting is conducted at about 190.5° C. yielding an acid having acid number of about 191, 11.2% P and 22.0% S. The resulting acid (1000 parts) is added to a slurry of 152.06 parts zinc oxide and 82.96 parts mineral oil, and reacted at 80° C. with the evolution of water. When the neutralization is completed, remaining water and unreacted alcohol are vacuum stripped at 99° C. and the residue is filtered. The filtrate is further diluted with mineral oil to 9.5% P, 10.6% Zn and 20.0% S.

EXAMPLE B-3

Following substantially the procedure of Examples B-1 and B-2, a phosphorodithioic acid is prepared by reacting 68.6 parts of a mixture of alcohols containing 28.2% by weight isopropanol and 71.8% by weight 4-methyl-2-pentanol. The zinc salt of this acid is prepared by reacting 93.7 parts of the acid with a slurry of 13.5 parts zinc oxide in 6.3 parts mineral oil. The resulting salt contains 10.5% zinc, 9.5% P and 20.5% S.

(C) Hydrocarbyl Phosphites

Compositions of the present invention may also include (C) a hydrocarbyl phosphite. The phosphite may be represented by the following formulae:

(III)

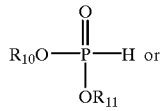

(IV)

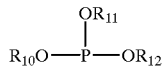

wherein each 'R' group is independently hydrogen or a hydrocarbyl group provided at least one of $R_{10}$ and $R_{11}$, is hydrocarbyl. In an especially preferred embodiment, the phosphite has the formula (III) and $R_{10}$ and $R_{11}$ are each, independently, hydrocarbyl.

Within the constraints of the above proviso, it is preferred that each of $R_{10}$, $R_{11}$, and $R_{12}$ is independently a hydrogen or a hydrocarbyl group having from 1 to about 30, more preferably from 1 to about 18, and more preferably from about 1 to about 8 carbon atoms. Each $R_{10}$, $R_{11}$, and $R_{12}$ group may be independently alkyl, alkenyl or aryl. When the group is aryl it contains at least 6 carbon atoms; preferably 6 to about 18 carbon atoms. Examples of alkyl or alkenyl groups are propyl, butyl, hexyl, heptyl, octyl, oleyl, linolyl, stearyl, etc. Examples of aryl groups are phenyl, naphthyl, heptylphenyl, etc. Preferably each of these groups is independently propyl, butyl, pentyl, hexyl, heptyl, oleyl or phenyl, more preferably butyl, octyl or phenyl and more preferably butyl.

The groups $R_{10}$, $R_{11}$, and $R_{12}$ may also comprise a mixture of hydrocarbyl groups derived from commercial mixed alcohols.

Examples of monohydric alcohols and alcohol mixtures include commercially available "Alfol" alcohols marketed by Continental Oil Corporation. Alfol 810 is a mixture containing alcohols consisting essentially of straight-chain, primary alcohols having 8 to 10 carbon atoms. Alfol 812 is a mixture comprising mostly $C_{12}$ fatty alcohols. Alfol 1218 is a mixture of synthetic, primary, straight-chain alcohols having from 12 to 18 carbon atoms. Alfol 20+ alcohols are mixtures of 18–28 primary alcohols having mostly, on an alcohol basis, $C_{20}$ alcohols as determined by GLC (gas-liquid-chromatography).

Another group of commercially available alcohol mixtures includes the "Neodol" products available from Shell Chemical Company. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ and $C_{15}$ linear alcohols. Neodol 91 is a mixture of $C_9$, $C_{10}$ and $C_{11}$ alcohols.

Another example of a commercially available alcohol mixture is Adol 60 which comprises about 75% by weight of a straight-chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Phosphites and their preparation are known and many phosphites are available commercially. Particularly useful phosphites are dibutylhydrogen phosphite, trioleyl phosphite and triphenyl phosphite. Preferred phosphite esters are generally dialkyl hydrogen phosphites.

A number of dialkyl hydrogen phosphites are commercially available, such as lower dialkyl hydrogen phosphites, which are preferred. Lower dialkyl hydrogen phosphites include dimethyl, diethyl, dipropyl, dibutyl, dipentyl and dihexyl hydrogen phosphites. Also mixed alkyl hydrogen phosphites are useful in the present invention. Examples of mixed alkyl hydrogen phosphites include ethyl, butyl; propyl, pentyl; and methyl, pentyl hydrogen phosphites.

The preferred dihydrocarbyl phosphites (C) useful in the compositions of the present invention may be prepared by techniques well known in the art, and many are available commercially. In one method of preparation, a lower molecular weight dialkylphosphite (e.g., dimethyl) is reacted with alcohols comprising a straight-chain alcohol, a branched-chain alcohol or mixtures thereof. As noted above, each of the two types of alcohols may themselves comprise mixtures. Thus, the straight-chain alcohol may comprise a mixture of straight-chain alcohols and the branched-chain alcohols may comprise a mixture of branched-chain alcohols. The higher molecular weight alcohols replace the methyl groups (analogous to classic transesterification) with the formation of methanol which is stripped from the reaction mixture.

In another embodiment, the branched chain hydrocarbyl group can be introduced into a dialkylphosphite by reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group, and, apparently because of the size of the neopentyl group, the second methyl group is not displaced by the neopentyl alcohol. Another neo alcohol having utility in this invention is 2,2,4-trimethyl-1-pentanol.

In another embodiment, mixed aliphatic-aromatic phosphites and aliphatic phosphites may be prepared by reacting an aromatic phosphite such as triphenyl phosphite, with aliphatic alcohols to replace one or more of the aromatic groups with aliphatic groups. Thus, for example, triphenyl phosphite may be reacted with butyl alcohol to prepare butyl phosphites. Dialkyl hydrogen phosphites may be prepared by reacting two moles of aliphatic alcohol with one mole of triphenyl phosphite, subsequently or concurrently with one mole of water.

Dihydrocarbyl phosphites are generally considered to have a tautomeric structure.

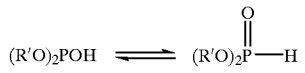

The following examples illustrate the preparation of some of the phosphite esters (C) which are useful in the compositions of the present invention. Unless otherwise indicated in the following examples and elsewhere in the specification and claims, all parts and percentages are by weight, and all temperatures are in degrees Celsius.

EXAMPLE C-1

A mixture of 911.4 parts (7 moles) of 2-ethylhexanol, 1022 parts (7 moles) of Alfol 8–10, and 777.7 parts (7 moles) of dimethylphosphite is prepared and heated to 125° C. while purging with nitrogen and removing methanol as a distillate. After about 6 hours, the mixture was heated to 145° C. and maintained at this temperature for an additional 6 hours whereupon about 406 parts of distillate are recovered. The reaction mixture is stripped to 150° C. at 50 mm. Hg., and an additional 40 parts of distillate are recovered. The residue is filtered through a filter aid and the filtrate is the desired mixed dialkyl hydrogen phosphite containing, by analysis, 9.6% phosphorus (theory, 9.7%).

EXAMPLE C-2

A mixture of 468.7 parts (3.6 moles) of 2-ethylhexanol, 1050.8 parts (7.20 moles) of Alfol 8–10, and 600 parts (5.4 moles) of dimethylphosphite is prepared and heated to 135° C. while purging with nitrogen. The mixture is heated slowly to 145° C. and maintained at this temperature for about 6 hours whereupon a total of 183.4 parts of distillate are recovered. The residue is vacuum stripped to 145° C. (10 mm. Hg.) and 146.3 parts of additional distillate are recovered. The residue is filtered through a filter aid, and the filtrate is the desired product containing 9.3% phosphorus (theory, 9.45%).

EXAMPLE C-3

A mixture of 518 parts (7 moles) of n-butanol, 911.4 parts (7 moles) of 2-ethylhexanol, and 777.7 parts (7 moles) of dimethylphosphite is prepared and heated to 120° C. while blowing with nitrogen. After about 7 hours, 322.4 parts of distillate are collected, and the material then is vacuum stripped (50 mm. Hg. at 140° C.) whereupon an additional 198.1 parts of distillate are recovered. The residue is filtered through a filter aid, and the filtrate is the desired product containing 12.9% phosphorus (theory, 12.3%).

EXAMPLE C-4

A mixture of 193 parts (2.2 moles) of 2,2-dimethyl-1-propanol and 242 parts (2.2 moles) of dimethylphosphite is prepared and heated to about 120° C. while blowing with nitrogen. A distillate is removed and collected, and the residue is vacuum stripped. The residue is filtered and the filtrate is the desired product containing 14.2% phosphorus.

(D) Aliphatic Group Substituted Carboxylic Acid or Anhydride

In one embodiment, the grease compositions additionally comprise (D) at least one of an aliphatic group substituted carboxylic acid, an anhydride thereof, and an aliphatic group substituted lactone wherein the aliphatic group contains at least about 8, often at least about 12 carbon atoms, and up to about 500 carbon atoms, preferably from about 20, often from about 30 to about 300 carbon atoms and often from about 30 to about 150 carbon atoms, and frequently from about 30 to about 100 carbon atoms.

Incorporation of component (D) is optional. It has been discovered that the presence of component (D) frequently enhances the effectiveness of the additive systems of this invention when the base grease is prepared from LVI and MVI oils or is prepared in an open kettle.

In one embodiment, component (D) is an aliphatic substituted succinic anhydride or acid containing from about 12 to about 500 carbon atoms in the aliphatic substituent, preferably from about 30 to about 400 carbon atoms, and often from about 50 to about 200 carbon atoms. Patents describing aliphatic carboxylic acids, anhydrides and lactones and the like useful in the grease compositions, and methods for preparing them include, among numerous others, U.S. Pat. Nos. 3,215,707 (Rense); U.S. Pat. No. 3,219,666 (Norman et al), U.S. Pat. No. 3,231,587 (Rense); 3,912,764 (Palmer); U.S. Pat. No. 4,110,349 (Cohen); and U.S. Pat. No. 4,234,435 (Meinhardt et al); U.S. Pat. No. 5,696,060 ((Baker et al): U.S. Pat. No. 5,696,067 (Adams et al); and U.K. 1,440,219.

As indicated in the above-mentioned patents, which are hereby incorporated by reference for their disclosure of compounds useful as component (D) of this invention, the carboxylic acids (or various derivatives thereof) are usually derived by the reaction of a carboxylic acid containing compound with a polyalkene or halogenated derivative thereof or a suitable olefin. Carboxylic acid containing compounds useful as reactants to form component (D) include α,β-unsaturated materials such as acrylic and methacrylic acids, maleic acid, esters of these acids, compounds of the formula $$R^3C(O)(R^4)_nC(O)OR^5 \quad (V)$$

and reactive sources thereof such as compounds of the formula

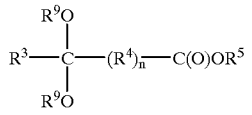

(VI)

wherein each of $R^3$, $R^5$ and each $R^9$ is independently H or a hydrocarbyl group, $R^4$ is a divalent hydrocarbylene group, preferably lower alkylene, more preferably methylene, ethylene or propylene, and n is 0 or 1, preferably, 0.

The polyalkenes from which the carboxylic acids (D) are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)". Especially preferred polyalkenes are polypropylene and polybutylene, especially, polyisobutylene, containing from about 20 to about 300 carbon atoms, often from about 30, frequently from about 50 to about 100 carbon atoms.

The olefin monomers from which the polyalkenes are derived are polymerizable olefin monomers characterized by the presence of one or more ethylenically unsaturated groups (i.e., >C═C<); that is, they are monolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterize by the presence in their structure of the group >C═CH2. However, polymerizable internal olefin monomers (sometimes referred to in the literature as medial olefins) characterized by the presence within their structure of the group

—C—C═C—C— can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Preferred materials useful as component (D) include polyolefin substituted succinic acids, succinic anhydrides, ester acids, lactones or lactone acids. Especially preferred are the succinic anhydrides.

Component (D) is generally used in the grease compositions of this invention in amounts ranging from about 0.025% to about 2%, often up to about 1% by weight, of the grease composition, preferably from about 0.04% to about 0.25% by weight.

Non-limiting examples of compounds useful as component (D) include those illustrated in the following examples:

EXAMPLE D-1

A mixture of 6400 parts (4 moles) of a polybutene comprising predominantly isobutene units and having a molecular weight of about 1600 and 408 parts (4.16 moles) of maleic anhydride is heated at 225–240° C. for 4 hours. It is then cooled to 170° C. and an additional 102 parts (1.04 moles) of maleic anhydride is added, followed by 70 parts (0.99 mole) of chlorine; the latter is added over 3 hours at 170–215° C. The mixture is heated for an additional 3 hours at 215° C. and is then vacuum stripped at 220° C. and filtered through diatomaceous earth. The product is the desired polybutenyl-substituted succinic anhydride having a saponification number of 61.8.

EXAMPLE D-2

A monocarboxylic acid is prepared by chlorinating a polyisobutene having a molecular weight of 750 to a product having a chlorine content of 3.6% by weight, converting the product to the corresponding nitrile by reaction with an equivalent amount of potassium cyanide in the presence of a catalytic amount of cuprous cyanide and hydrolyzing the resulting nitrile by treatment with 50% excess of a dilute aqueous sulfuric acid at the reflux temperature.

EXAMPLE D-3

A high molecular weight mono-carboxylic acid is prepared by telomerizing ethylene with carbon tetrachloride to a telomer having an average of 35 ethylene radicals per molecule and hydrolyzing the telomer to the corresponding acid in according with the procedure described in British Patent No. 581,899.

EXAMPLE D-4

A polybutenyl succinic anhydride is prepared by the reaction of a chlorinated polybutylene with maleic anhydride at 200° C. The polybutenyl radical has an average molecular weight of 805 and contains primarily isobutene units. The resulting alkenyl succinic anhydride is found to have an acid number of 113 (corresponding to an equivalent weight of 500).

EXAMPLE D-5

A lactone acid is prepared by reacting 2 equivalents of a polyolefin (Mn about 900) substituted succinic anhydride with 1.02 equivalents of water at a temperature of about 90° C. in the presence of a catalytic amount of concentrated sulfuric acid. Following completion of the reaction, the sulfuric acid catalyst is neutralized with sodium carbonate and the reaction mixture is filtered.

EXAMPLE D-6

An ester acid is prepared by reacting 2 equivalents of an alkyl substituted succinic anhydride having an average of about 35 carbon atoms in the alkyl group with 1 mole of ethanol.

EXAMPLE D-7

A reactor is charged with 1000 parts of polybutene having a molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110 to 188° C. The exothermic reaction is controlled as not to exceed 188° C. The batch is blown with nitrogen then stored.

EXAMPLE D-8

The procedure of Example D-7 is repeated employing 1000 parts of polybutene having a molecular weight determined by vapor phase osmometry of about 1650 and consisting primarily of isobutene units and 106 parts maleic anhydride. $Cl_2$ is added beginning at 130° C. and added a near continuous rate such that the maximum temperature of 188° C. is reached near the end of chlorination. The residue is blown with nitrogen and collected.

EXAMPLE D-9

A reactor is charged with 3000 parts of a polyisobutene having a number average molecular weight of about 1000 and which contains about 80 mole % terminal vinylidene groups and 6 parts 70% aqueous methanesulfonic acid. The materials are heated to 160° C. under $N_2$ followed by addition of 577.2 parts 50% aqueous glyoxylic acid over 4 hours while maintaining 155–160° C. Water is removed and is collected in a Dean-Stark trap. The reaction is held at 160° C. for 5 hours, cooled to 140° C. and filtered. The filtrate has total acid no. (ASTM Procedure D-974)=34.7 and saponification no. (ASTM Procedure D-74)=53.2. $\overline{M}_n$ (Gel permeation chromatography (GPC))=1476 and $\overline{M}_w$ (GPC)=3067; unreacted polyisobutene (Thin layer chromatography-Flame ionization detector (TLC-FID))=8.6%.

Minimum amounts of each component to use in the grease compositions also depend to some extent upon the specific nature of the component, but generally at least about 0.25% of each of components (A), (B), and (C), and when used, at least about 0.025% by weight of component (D) is present. Useful amounts of component (A) range from about 0.25% to about 10% by weight, preferably about 0.5% to about 5%, more preferably from about 1% to about 2%. With respect to component (B), useful amounts for the purposes of this invention range from about 0.25% to about 5% by weight, preferably from about 0.5% to about 3%, more preferably from about 0.5% to about 1% by weight. Component (C) is generally present in amounts ranging from about 0.25% to about 5%, preferably from about 0.5% to about 3%, more preferably from about 0.75% to about 2% by weight, more often up to about 1% by weight. Component (D) is usually used in amounts ranging from about 0.025% to about 2.5%, preferably from about 0.04% and up to about 1.

It generally is not necessary to use more than about 5% by weight of the sulfur and phosphorus containing compound since no additional benefit is obtained and often, deteriorating performance with respect to the dropping point and other characteristics of the grease is observed above this treating level. More often no more than about 5% frequently no more than about 2% of the sulfur and phosphorus containing compound is employed. Often 1% by weight is sufficient.

It generally is not necessary to use more than a total of about 20% by weight of the components since no additional benefit is obtained and often, deteriorating performance with respect to the dropping point and other characteristics of the grease is observed above this treating level. More often no more than a total of about 10%, frequently no more than about 5% is employed. Often 1%–3% by weight is sufficient to provide an increase in dropping point.

In an especially preferred embodiment, the components are used in relative amounts ranging from about 1 part (A) to about 0.5–1.5 parts each of (B) and (C) to about 0.05 to about 0.1 part (D).

Thus, it is preferred to use the minimum amount of the additives consistent with attaining the desired dropping point elevation.

Components (A), (B), (C) and (D) may be present during grease formation, i.e., during formation of the thickener, or may be added after the base grease has been prepared. Normally, the components are added to the preformed base grease since they may be adversely affected during preparation of metal soap and complex thickeners.

Other additives may be incorporated into the base grease to improve performance of the grease as a lubricant. Such other additives including corrosion inhibitors, antioxidants, extreme pressure additives and others useful for improving specific performance characteristics of a base grease, are well-known and will readily occur to those skilled in the art. Oftentimes these other additives have an adverse effect on the dropping point of the grease. The use of components (A)–(D) with these other additives often compensates for this effect.

The following examples illustrate grease compositions of this invention which indicate the benefits obtained employing this invention. It is to be understood that these examples are intended to be illustrative only and are not intended to be limiting in any way. Dropping points are determined using ASTM Procedure D-2265. All amounts unless indicated otherwise are on an oil free basis and are by weight. Product of examples of this invention are used as prepared, including any diluent. Temperatures, unless indicated otherwise, are in degrees Celsius.

EXAMPLE A

A simple lithium 12-hydroxystearate thickened base grease is prepared in a contactor by blending 9.75 parts 12-hydroxy stearic acid (Cenwax A, Union Camp) in 70 parts mineral oil (800 SUS @ 40° C., Texaco HVI) at 77° C. until the acid is dissolved, whereupon 1.75 parts $LiOH.H_2O$ (FMC) are added. The contactor is closed and the pressure increases to 80 PSI. The materials are heated to 204° C., the temperature is maintained for 0.2 hour, then the contactor is depressurized. The temperature is reduced to 177° C., the materials are transferred to a finishing kettle, 15.3 parts additional oil are added and the materials are mixed thoroughly until they are uniform. Dropping point is 207° C.

EXAMPLE B

An additive concentrate is prepared by blending at a moderately elevated temperature 28.125 parts dibutyl hydrogen phosphite, 50.47 parts of the calcium overbased salicylate of Example A-14, 18.75 parts of the zinc salt of Example B-1 and 2.655 parts of the succinic anhydride of Example D-7. No adjustment is made for oil content.

EXAMPLE C

An additive concentrate is prepared by blending at a moderately elevated temperature 28.125 parts dibutyl hydrogen phosphite, 53.125 parts of the calcium overbased salicylate of Example A-14 and 18.75 parts of the zinc salt of Example B-1. No adjustment is made for oil content.

EXAMPLE D

An additive concentrate is prepared by blending at a moderately elevated temperature 28.125 parts dibutyl hydrogen phosphite, 50.47 parts of the calcium overbased salicylate of Example A-14, 18.75 parts of the zinc salt of Example B-2 and 2.655 parts of the succinic anhydride of Example D-7. No adjustment is made for oil content.

EXAMPLE E

An additive concentrate is prepared by blending at a moderately elevated temperature 28.125 parts dibutyl hydrogen phosphite, 53.125 parts of the calcium overbased salicylate of Example A-14 and 18.75 parts of the zinc salt of Example B-2. No adjustment is made for oil content.

Grease compositions are prepared by blending into 96.8 parts of the base grease of example A, 3.2 parts of the indicated additive concentrates.

| Example | Additive Concentrate | Dropping Point (° C.) |
|---|---|---|
| F | B | >300 |
| G | C | 252° C. |
| H | D | >300 |
| I | E | >300 |

In each example, the treatment increases the dropping point of the base grease from 207° to greater than (>) 300° C. The odor of each of grease compositions F-I is considered to be 'good'.

From the foregoing Examples, it is apparent that the grease compositions of this invention have dropping points significantly greater than the corresponding base grease without the dropping point increasing additives.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An improved grease composition comprising a major amount of an oil-based, simple metal soap thickened base grease and (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid wherein the acid is selected from the group consisting of compounds represented by the formula (I)

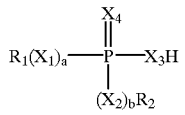

wherein each $X_1$, $X_2$, $X_3$ and $X_4$ is independently oxygen or sulfur provided at least one is sulfur; each a and b is independently 0 or 1; and wherein each member of the group consisting of $R_1$ and $R_2$ is independently selected from hydrogen and hydrocarbyl; and (C) from about 0.25% to about 5% by weight of a hydrocarbyl phosphite wherein the dropping point of the improved grease composition is at least about 15° C. greater than that of the base grease as measured by ASTM procedure D-2265.

2. The grease composition of claim 1, wherein the metal of the metal soap is selected from the group consisting of alkali metal, alkaline earth metal, titanium and aluminum.

3. The grease composition of claim 2, wherein the metal of the metal soap is an alkali metal selected from the group consisting of sodium or lithium or an alkaline earth metal selected from the group consisting of barium, calcium, or magnesium.

4. The grease composition of claim 1, wherein the metal soap is an aliphatic $C_8$ to $C_{24}$ mono-carboxylate.

5. The grease composition of claim 4, wherein the mono-carboxylate is hydroxy-substituted.

6. The grease composition of claim 5, wherein the metal soap is lithium 12-hydroxy stearate.

7. The grease composition of claim 1 wherein the over-based metal salt (A) is an alkali metal salt, an alkaline earth metal salt or a zinc salt.

8. The grease composition of claim 7 wherein the over-based metal salt (A) is a zinc salt or an alkaline earth metal salt selected from the group consisting of calcium, magnesium and barium salts.

9. The grease composition of claim 1 wherein the over-based metal salt (A) is selected from the group consisting of carboxylates, phenates and sulfonates.

10. The grease composition of claim 9 wherein the overbased metal salt is a carboxylate containing at least about 8 carbon atoms.

11. The grease composition of claim 9 wherein the overbased metal salt is an alkylbenzene sulfonate containing one or two alkyl substituents.

12. The grease composition of claim 11 wherein the alkylbenzene sulfonate has at least one alkyl substituent containing at least about 8 carbon atoms.

13. The grease composition of claim 9 wherein the overbased metal salt is an alkyl or alkenyl substituted phenate, wherein the alkyl or alkenyl substituent contains at least about 8 carbon atoms.

14. The grease composition of claim 1 wherein the overbased metal salt (A) is an aliphatic group substituted alkaline earth salicylate.

15. The grease composition of claim 1 wherein the metal salt (B) is a zinc salt.

16. The grease composition of claim 1, wherein a and b are each 1, $X_4$ is sulfur and one of $X_1$, $X_2$ and $X_3$ is sulfur and the rest are oxygen and each of $R_1$ and $R_2$ is independently an aliphatic hydrocarbon group containing from 3 to about 24 carbon atoms.

17. The grease composition of claim 16 wherein each of $R_1$ and $R_2$ is a primary alkyl group.

18. The grease composition of claim 1 wherein the sulfur and phosphorus containing acid is selected from the group consisting of compounds represented by the formula (II)

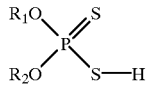

wherein each of $R_1$ and $R_2$ is, independently, a hydrocarbyl group.

19. The grease composition of claim 1, wherein each hydrocarbyl group of the phosphite (C) independently contains from 1 to about 30 carbon atoms.

20. The grease composition of claim 1 wherein the phosphite is a dihydrocarbyl hydrogen phosphite.

21. The grease composition of claim 20 wherein the phosphite (C) is a dialiphatic group substituted hydrogen phosphite, each aliphatic group containing, independently, from 1 to about 18 carbon atoms.

22. The grease composition of claim 21 wherein each aliphatic group contains about 4 carbon atoms.

23. The grease composition of claim 1 further comprising (D) from about 0.025% to about 2% by weight of at least one of an aliphatic group substituted carboxylic acid, an anhydride thereof and an aliphatic group substituted lactone wherein the aliphatic group contains at least about 8 carbon atoms.

24. The grease composition of claim 23 wherein (D) is a polyolefin substituted succinic acid or anhydride, or ester acid or lactone acid thereof.

25. The grease composition of claim 24 wherein the polyolefin substituent is a polypropylene group, a polybutene group or a mixture thereof containing from about 20 to about 300 carbon atoms.

26. The grease composition of claim 1 wherein the simple metal soap thickened base grease has been prepared in an open grease kettle.

27. The grease composition of claim 1 wherein the simple metal soap thickened base grease has been prepared in a continuous grease processor.

28. The grease composition of claim 1 wherein the simple metal soap thickened base grease has been prepared in a contactor.

29. The grease composition of claim 1 wherein the base grease is a low or medium viscosity index oil-based simple metal soap thickened base grease.

30. A grease composition comprising a major amount of a oil-based, simple metal soap thickened base grease, (A) a metal overbased aliphatic hydrocarbon substituted aromatic carboxylate;

(B) at least one metal salt of a phosphorus and sulfur containing acid, said salt prepared by the process comprising reacting at a temperature of from about 0°0 C. to about 150° C., approximately equivalent amounts of at least one member of the group consisting of zinc, copper and molybdenum oxides and hydroxides and a phosphorodithioic acid having the formula (II)

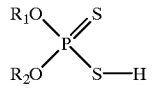

wherein each $R_1$ and $R_2$ is independently a hydrocarbyl group; and (C) at least one dihydrocarbyl hydrogen phosphite of the formula (III)

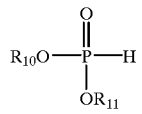

wherein each of $R_{10}$ and $R_{11}$ is independently a hydrocarbyl group containing from 1 to about 50 carbon atoms, wherein (A) is present in amounts ranging from about 0.25% to about 10% by weight, and (B) and (C) are each, independently, present in amounts ranging from about 0.25% to about 5% by weight, wherein the dropping point of the improved grease composition is at least about 50° C. greater than that of the base grease as measured by ASTM procedure D-2265.

31. The grease composition of claim 30 wherein the overbased metal carboxylate (A) is an alkyl or alkenyl substituted salicylate wherein the substituent contains from about 12 to about 50 carbon atoms.

32. The grease composition of claim 30 wherein (A) is an overbased calcium alkyl salicylate having a metal ratio of from 3 to about 20, (B) is a composition prepared by reacting the phosphorodithioic acid wherein each of $R_1$ and $R_2$ is, independently, an aliphatic group having from 3 to about 12 carbon atoms or an aromatic group containing from 6 to about 12 carbon atoms, with a metal oxide or hydroxide; and (C) is a dialkyl phosphite wherein each of $R_{10}$ and $R_{11}$, independently, contains from about 3 to about 8 carbon atoms.

33. The grease composition of claim 30 further comprising from about 0.025 to about 2% by weight (D) of at least one of an aliphatic group substituted carboxylic acid, an anhydride thereof and an aliphatic group substituted lactone, wherein the aliphatic group contains at least about 8 carbon atoms.

34. The grease composition of claim 33 wherein (D) is a polyisobutylene-substituted succinic anhydride containing from about 30 to about 100 carbon atoms in the polyisobutylene substituent.

35. The grease composition of claim 30 wherein zinc oxide or hydroxide is reacted with the phosphorodithioic acid.

36. The grease composition of claim 30 where in each of $R_1$ and $R_2$ is independently an aliphatic hydrocarbon group containing from 3 to about 24 carbon atoms.

37. The grease composition of claim 30 comprising from about 0.5% to about 5% by weight of (A), from about 0.25–3% by weight of (B), and from 0.25–3% by weight of (C).

38. The grease composition of claim 33 comprising from about 0.04% to about 0.25% by weight of (D).

39. An improved grease composition comprising a major amount of an oil-based, metal soap thickened base grease selected from the group consisting of complex grease and failed complex grease, (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid wherein the acid is selected from the group consisting of acids represented by the formula (I)

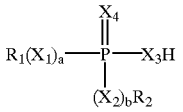

wherein each $X_1$, $X_2$, $X_3$ and $X_4$ is independently oxygen or sulfur provided at least one is sulfur; each a and b is independently 0 or 1; and wherein each member of $R_1$ and $R_2$ is, independently, selected from hydrogen and hydrocarbyl; and (C) from about 0.25% to about 5% by weight of a hydrocarbyl phosphite wherein the dropping point of the improved grease composition is at least about 15° C. greater than that of the base grease as measured by ASTM procedure D-2265.

40. The grease composition of claim 39 wherein the metal salt (B) is a zinc salt.

41. The grease composition of claim 39 wherein each of a and b is 1, each of $X_3$ and $X_4$ is S, each of $X_1$ and $X_2$ is O, each of $R_1$ and $R_2$ is an aliphatic hydrocarbon group containing from 3 to about 24 carbon atoms.

42. The grease composition of claim 39 further comprising (D) from about 0.025% to about 2% by weight of at least one of an aliphatic group substituted carboxylic acid, anhydride thereof and an aliphatic group substituted lactone wherein the aliphatic group contains at least about 8 carbon atoms.

43. The grease composition of claim 39 wherein the phosphite (C) is a dialiphatic group substituted hydrogen phosphite, each aliphatic group containing, independently, from 1 to about 18 carbon atoms.

44. An improved grease composition having a dropping point greater than 260° C. comprising a major amount of an oil-based, metal soap thickened base grease having a dropping point less than 260° C., wherein dropping points are measured by ASTM Procedure D-2265, (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid selected from the group consisting of compounds represented by the formula (I)

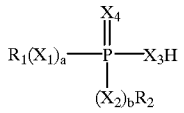

wherein each $X_1$, $X_2$, $X_3$ and $X_4$ is independently oxygen or sulfur provided at least one is sulfur; each a and b is independently 0 or 1; and wherein each member of $R_1$ and $R_2$ is, independently, selected from hydrogen and hydrocarbyl; and (C) from about 0.25% to about 5% by weight of a hydrocarbyl phosphite.

45. The grease composition of claim 44 wherein the metal salt (B) is a zinc salt.

46. The grease composition of claim 44 further comprising (D) from about 0.025% to about 2% by weight of at least one of an aliphatic group substituted carboxylic acid, an anhydride thereof and an aliphatic group substituted lactone wherein the aliphatic group contains at least about 8 carbon atoms.

47. A method of increasing the dropping point of an oil-based simple metal soap thickened base grease by at least about 15° C. as measured by ASTM procedure D-2265, said method comprising incorporating into the base grease (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid selected from the group consisting of compounds represented by the formula (I)

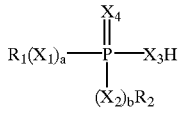

wherein each $X_1$, $X_2$, $X_3$ and $X_4$ is independently oxygen or sulfur provided at least one is sulfur; each a and b is independently 0 or 1; and wherein each member of $R_1$ and $R_2$ is, independently, selected from hydrogen and hydrocarbyl; and (C) from about 0.25% to about 5% by weight of a hydrocarbyl phosphite.

48. The method of claim 47 further comprising incorporating into the base grease (D) from about 0.025% to about 2% by weight of at least one of an aliphatic carboxylic acid, an anhydride thereof and an aliphatic group substituted lactone wherein the aliphatic group contains at least about 8 carbon atoms.

49. The method of claim 47 wherein the base grease is a low or medium viscosity index oil-based simple metal soap thickened base grease.

50. The method of claim 47 wherein the metal salt (B) is a zinc salt.

51. The method of claim 47 wherein a and b are 1, each of $R_1$ and $R_2$ is independently an aliphatic hydrocarbon group containing from 3 to about 24 carbon atoms, $X_3$ is S, one of $X_1$, $X_2$ and $X_4$ is S, and the remainder are O.

52. A method of increasing the dropping point of an oil-based metal soap thickened base grease selected from the group consisting of complex grease and failed complex grease by at least about 15° C. as measured by ASTM procedure D-2265, said method comprising incorporating into the base grease (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid selected from the group consisting of compounds represented by the formula (I)

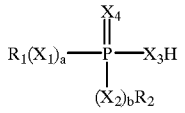

wherein each $X_1$, $X_2$, $X_3$ and $X_4$ is independently oxygen or sulfur provided at least one is sulfur; each a and b is independently 0 or 1; and wherein each member of $R_1$ and $R_2$, is, independently, selected from hydrogen and hydrocarbyl; and (C) from about 0.25% to about 5% by weight of a hydrocarbyl phosphite.

53. The method of claim 52 wherein the metal salt (B) is a zinc salt.

54. The method of claim 52 further comprising incorporating into the base grease (D) from about 0.025% to about 2% by weight of an aliphatic carboxylic acid, an anhydride thereof and an aliphatic substituted lactone wherein the aliphatic group contains at least about 8 carbon atoms.

55. A method of increasing the dropping point of an oil-based metal soap thickened base grease having a dropping point less than 260° C., to at least 260° C., wherein dropping points are measured by ASTM procedure D-2265, said method comprising incorporating into the base grease (A) from about 0.25% to about 10% by weight of an overbased metal salt of an organic acid other than a phosphorus- and sulfur-containing acid;

(B) from about 0.25% to about 5% by weight of at least one member of the group consisting of zinc, copper and molybdenum salts of a phosphorus and sulfur containing acid selected from the group consisting of compounds represented by the formula (I)

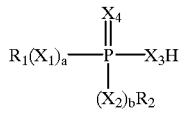

wherein each $X_1$, $X_2$, $X_3$ and $X_4$ is independently oxygen or sulfur provided at least one is sulfur; each a and b is independently 0 or 1; and wherein each member of $R_1$ and $R_2$ is, independently, selected from hydrogen and hydrocarbyl; and (C) from about 0.25% to about 5% by weight of a hydrocarbyl phosphite.

56. The method of claim 55 wherein the metal salt (B) is a zinc salt.

57. The method of claim 55 further comprising incorporating (D) from about 0.025% to about 2% by weight of an aliphatic carboxylic acid, an anhydride thereof and an aliphatic substituted lactone wherein the aliphatic group contains at least about 8, carbon atoms.

* * * * *